US005239977A

United States Patent [19]

Thomas

[11] Patent Number: 5,239,977

[45] Date of Patent: Aug. 31, 1993

[54] ELBOW FOR ATTACHING ACCESSORIES TO AN ARCHERY BOW

[75] Inventor: Bruce A. Thomas, Swartz Creek, Mich.

[73] Assignee: Archery Dynamics, Inc., Swartz Creek, Mich.

[21] Appl. No.: 954,654

[22] Filed: Sep. 30, 1992

[51] Int. Cl.[5] ..... F41B 5/20; F41B 5/14

[52] U.S. Cl. ..... 124/89; 124/88; 403/83; 403/102; 411/383

[58] Field of Search ..... 124/23.1, 24.1, 25.6, 124/44.5, 86, 88, 89, 90; 403/79, 83, 91, 102, 156; 411/383, 388, 389

[56] References Cited

U.S. PATENT DOCUMENTS

| | | | |
|---|---|---|---|
| 1,903,863 | 4/1933 | Hayden | 403/79 |
| 3,342,172 | 9/1967 | Sanders | 124/89 X |
| 3,512,512 | 5/1970 | Wentz | 124/24.1 |
| 4,377,152 | 3/1983 | Saunders | 124/23.1 |
| 4,491,123 | 1/1985 | Wirtz | 124/89 |
| 4,615,326 | 10/1986 | Rathbun | 124/88 |

*Primary Examiner*—Randolph A. Reese

*Assistant Examiner*—John Ricci

*Attorney, Agent, or Firm*—James C. McLaughlin

[57] ABSTRACT

An improved elbow used to attach accessories such as stabilizers to archery bows is disclosed. The elbow comprises: an extended arm having a threaded-end capable of being attached to the bow (facilitated in the preferred embodiment by a nut) with the other end having a spherical bevel surmounted by a flat-portion, a saddle shaped wrist capable of receiving the threaded end of the accessory and encompassing the arm, and a hinge coupling the arm and wrist. The hinge uses a special pin that passes loosely through the arm and tightly through both sides of the wrist, and that also functions as a spring. The elbow has two modes of use: an extended mode, when the attached accessory and arm are in line and the attached accessory is essentially parallel to the arrow; and a folded mode, where the attached stabilizer is pivoted down or up. The improvements of the preferred embodiment include a hinge that is much less prone to failure, a reduced tendency to unlock or loosen with vibration, a reduction to only four parts (only one of which is detachable), and simplified production and assembly.

16 Claims, 5 Drawing Sheets

ELBOW FOR ATTACHING ACCESSORIES TO AN ARCHERY BOW

TECHNICAL FIELD OF THE INVENTION

The technical field of the present invention is that of devices used to attach accessories such as stabilizers to archery bows. More specifically, the technical field encompasses elbow like devices used to attach accessories to archery bows.

BACKGROUND INFORMATION

Various types of stabilizers are used with archery bows (hereinafter referred to as simply "bows") and other devices (such as air guns) that produce mechanical impulses. The stabilizers are intended to reduce the detrimental effects of an impulse. Generally, stabilizers comprise one or more masses that are capable of moving in approximately the same direction as the impulse and usually the motion of such masses is not only opposed by the inertia of each mass (force proportional to acceleration) but also by one or more spring means (force proportional to displacement) or by viscous damping (force proportional to velocity). The outside shape of stabilizers tends to be extended and frequently cylindrical. A threaded distal end of a stabilizer is screwed to the outside edge of a bow riser (side facing away from the archer) pointing in approximately the same direction as that in which an arrow would be propelled.

The extended shape of a stabilizer and its attachment to the front of a bow results in an awkward arrangement when in the field (where a forward protruding stabilizer is prone to get snagged) and results in a need to store the stabilizer unattached to the bow when the bow is cased (for otherwise a bow with attached stabilizer would not fit). Both of these difficulties are attenuated, or even eliminated, when an elbow is placed between a stabilizer and a bow riser.

An elbow allows a stabilizer to pivot away from its normal position (thereby producing an arrangement that is significantly less likely to get snagged while in the field and a more compact arrangement when retaining the bow in a case) and yet allows a stabilizer selectively to be locked into its normal position. One end of the elbow is attached to the bow riser (in lieu of a stabilizer) and the other end of the elbow is attached to a stabilizer. Between the two ends of the elbow are means for pivoting and means for locking the pivot.

The use of an elbow for linking a bow and a stabilizer is discussed. However, an elbow may be used with any reasonable accessory.

Known elbows are: a tube loosely receiving a bolt such that the head of the bolt is flush with one end of the tube (head end) and such that the bolt extends past the other end of the tube (bow attachment end); a cap pivotly connected to the tube where the pivot is formed by two, short pins passing through the cap and a short distance into the tube near the head end of the tube (a pin is placed on each side of the cap); and an extended adapter that has a threaded recess at one end (stabilizer attachment end) and a threaded outside on the other end (locking end). The cap contains a threaded hole for receiving the locking end of the adapter. In use, a stabilizer is screwed into the stabilizer attachment end of the adapter, the adapter is screwed into the cap, and the bow attachment end of the bolt is screwed into the bow while the tube is held so that the cap is pointing in the desired direction. Then, when it is desired to lock the stabilizer in its extended position, the cap, adapter, and stabilizer are rotated into place and the adapter is screwed down through the cap onto the head end of the tube. Six parts are involved (bolt, tube, cap, two pins, and adapter). The known variation is the addition of a seventh part in the form of a plastic washer at the very end of the locking end of the adapter. The washer is probably added to reduce the sound of the locking action.

The primary difficulty with the known elbows (above described) is their tendency to fail in the vicinity of one of the pins. Of necessity, the pins extend only a very short way into the tube (or they would interfere with the bolt) and the pins are loose in the tube (or pivoting could not be effected). Thus the force of the locking is concentrated, tending to buckle the pins and to pull the pins out of the tube.

A secondary difficulty with the known elbows is a tendency for the device to unlock or loosen after being vibrated for a while. During locking an external torque is applied to the adapter that (when the adapter reaches the end of its travel against the head end of the tube) produces a longitudinal stress that (in turn) produces a slight longitudinal strain. After the torque is no longer applied, the slight longitudinal strain sets up a force against the threads, the friction of which hold the assembly together. The overturning moment of the extended stabilizer cycles as the assembly is vibrated causing variations in the longitudinal stress that eventually tends to cause the threads to "back out." Increasing torque during locking would attenuate this undesired tendency, but would tend to cause premature pin failure because of the resulting greater stress. The addition of the prior noted plastic washer might result in slightly more residual strain for the same residual strain with negligible to minor improvement in this difficulty.

A tertiary difficulty with the known elbows stems from the use of six or seven parts. When handling the device in the field the loose bolt and adapter are prone to being lost, though the washer could be used to keep the adapter from being able to be removed. Additionally, the use of so many parts increases the cost of producing and assembling the device, particularly when there are four threaded surfaces.

Accordingly, an object of the present invention is an improved elbow that is not prone to premature pivot failure.

Additional objects of the present invention are an improved elbow with reduced tendency to unlock or loosen with vibration, fewer loose or detachable parts, fewer parts, and simplified production and assembly.

SUMMARY OF THE INVENTION

The foregoing and other objects and advantages are achieved with the present invention. The preferred embodiment of the present invention comprises an arm having a threaded-end capable of being attached to the bow with the other end having a flat-portion, a wrist capable of receiving the threaded end of the stabilizer, and a hinge coupling the arm and wrist. The hinge comprises a special pin that passes loosely through the arm and tightly through the wrist and that also functions as a spring. The present invention has two modes of use: an extended mode, when the attached stabilizer and apparatus are in line and the stabilizer is essentially parallel to the arrow; and a folded mode, where the attached stabilizer is pivoted down.

In use, the threaded end of the stabilizer is screwed part way into the wrist, and the arm is screwed into the bow-riser. When it is desired to have the stabilizer in its operational position (extended mode), the stabilizer is raised to position and the threaded end of the stabilizer is screwed through the wrist to bear tightly against the flat-portion, compressing the pin, and thus locking the stabilizer into position. When it is desired to have the stabilizer out of the way (folded mode), the stabilizer is slightly unscrewed from the wrist, releasing the pin's compression, and the wrist and stabilizer are rotated downward. By providing a bevel between the flat-portion and the elongated surface of the arm, the amount the stabilizer needs to be rotated to move between the two modes is minimized. In the preferred embodiment the bevel is spherical.

DETAILED DESCRIPTION OF THE INVENTION AND ITS PREFERRED EMBODIMENT

Figure 1:
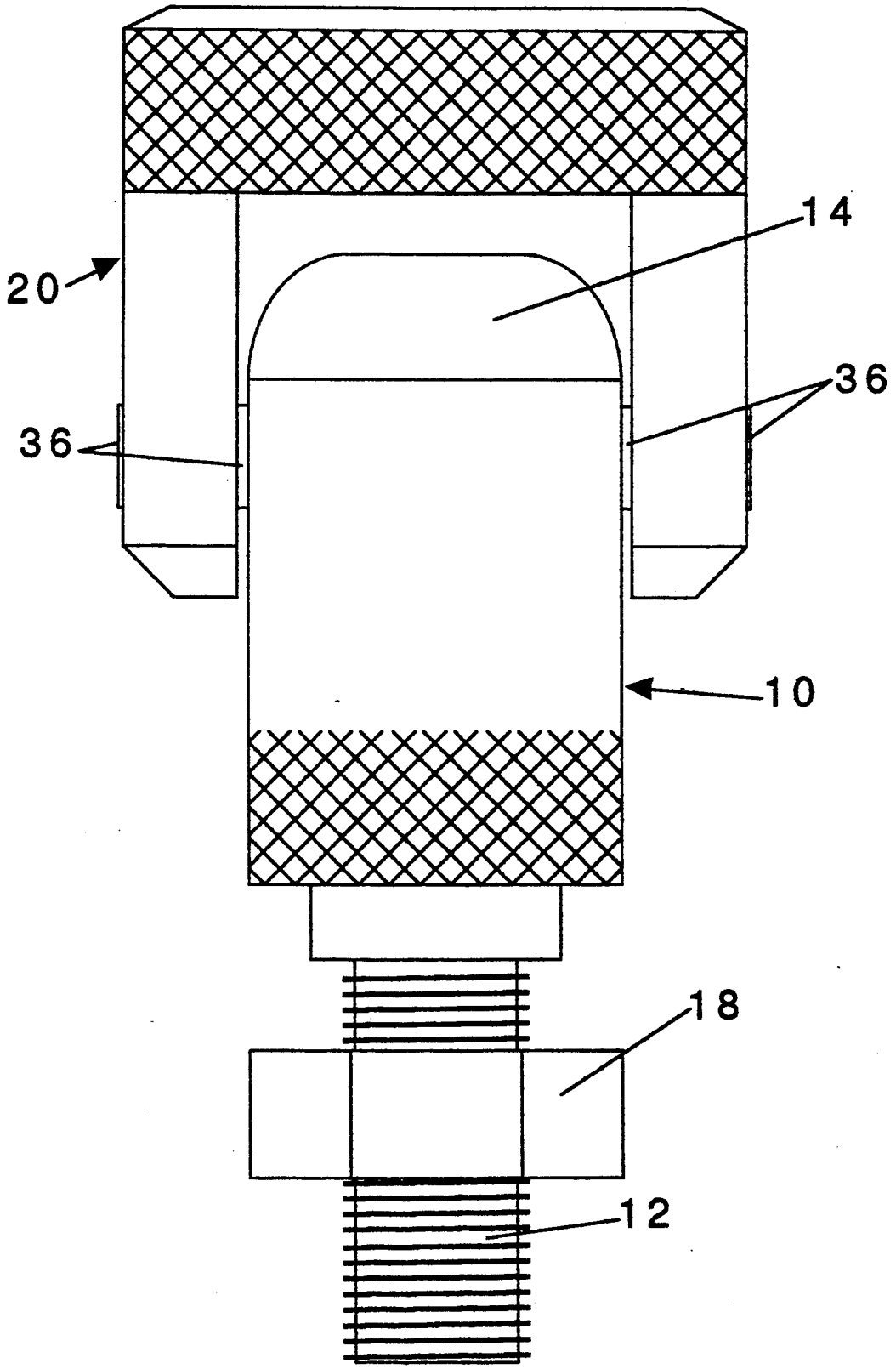
FIG. 1 is a side view of the preferred embodiment
Figure 2:
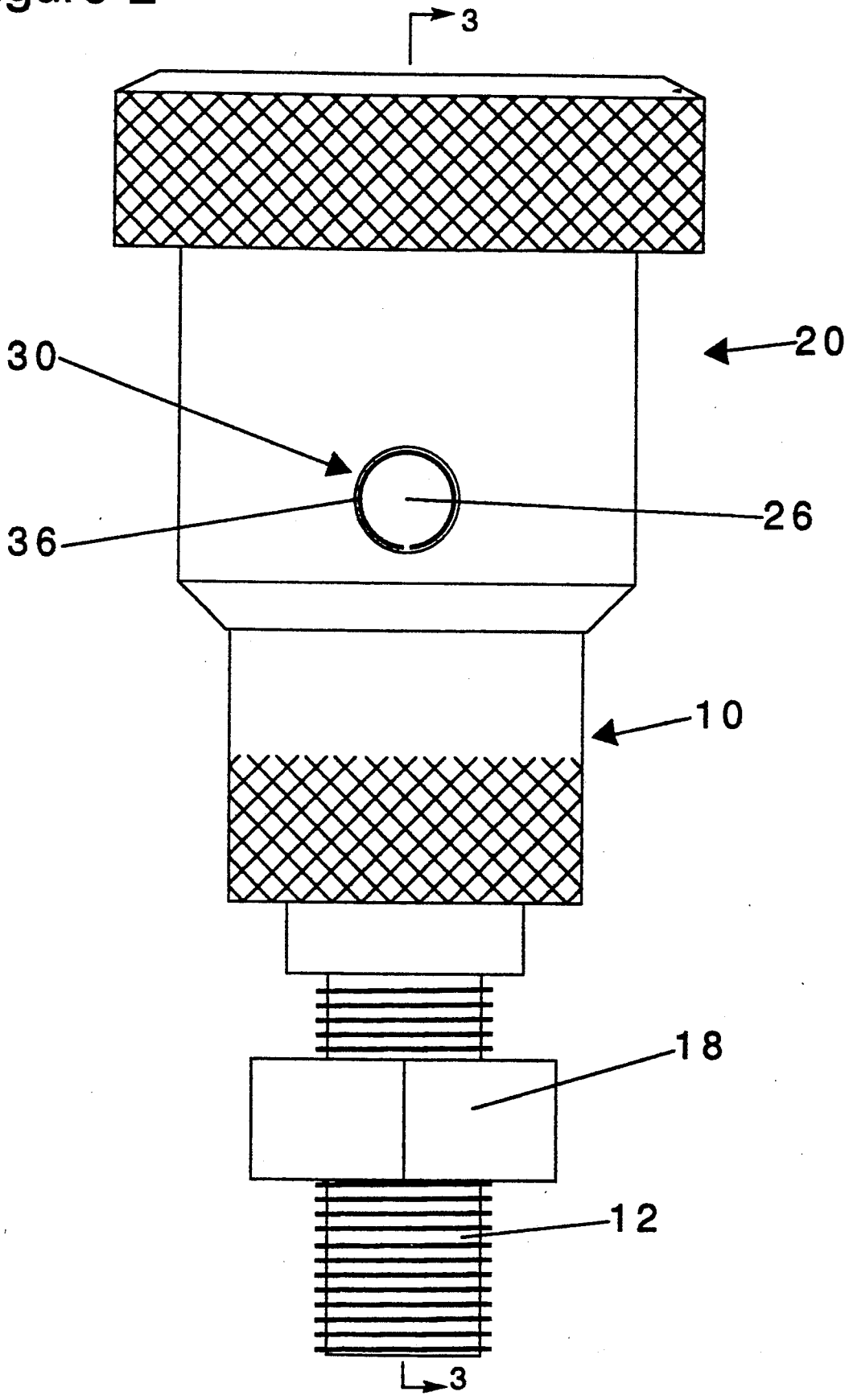
FIG. 2 is a side view of the preferred embodiment rotated 90 degrees from FIG. 1

The outside appearance of the preferred embodiment of the present invention is shown by FIGS. 1 and 2. These are side views rotated 90 degrees apart. These two views show arm 10 and wrist 20 aligned along a common axis as they are aligned when holding an associated stabilizer with its major axis essentially parallel to the major axis of an arrow (extended mode).

Arm 10 is elongated, has symmetry about its major axis, and is terminated by stud-end 12 and flat-end 14. A portion of the body of arm 10 is knurled to facilitate grasping. A hole of essentially circular cross section goes through the body of arm 10 in the vicinity of flat-end 14 normal to the major axis and constitutes pivot 16. In the preferred embodiment, this cylindrical opening (pivot 16) is produced by drilling with a #10 drill-bit and has a nominal diameter of 0.1935 inches.

Figure 3:
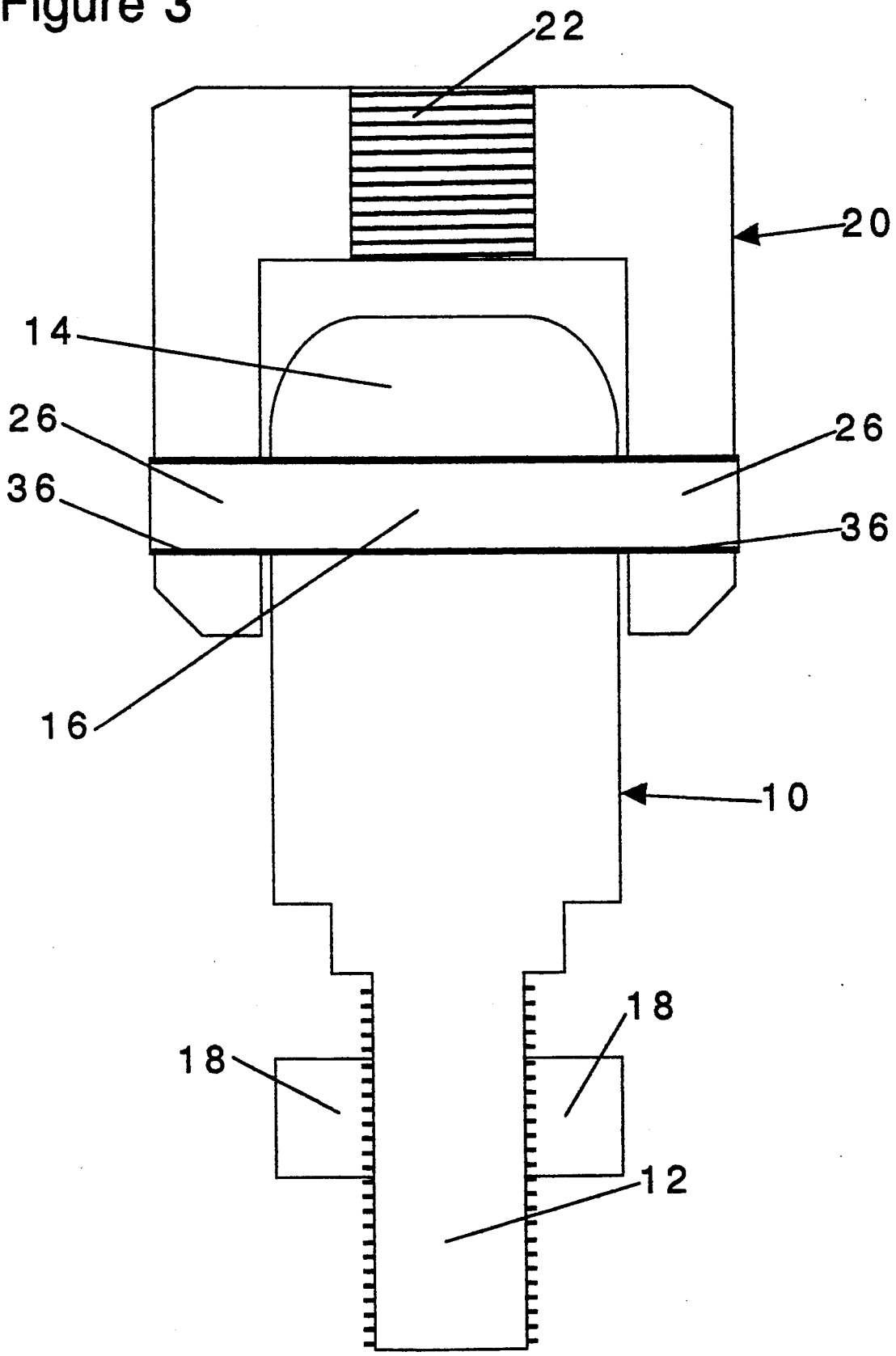
FIG. 3 is a cross section view

Stud-end 12 is threaded to mate with a threaded hole in the bow riser. (The present invention encompasses any means for attachment to the bow.) Flat-end 14 is terminated in circular flat-portion 15, the plane of which is normal to the major axis of arm 10. The threaded end of the stabilizer will press against flat-portion 15. The top view of FIG. 4 (where wrist 20 is hinged to the side as it would be in the folded mode) shows the extent of flat-portion 15. In the preferred embodiment, flat-portion 15 has a diameter slightly less than the diameter of receiving-hole 22 (see below) or about 0.265 inches. Flat-portion 15 should be a good bearing surface for the threaded end of the stabilizer or accessory used. The extent of flat-portion 15 should be either approximately the same as that of the end of the threaded end of the accessory or not greater than that of the receiving-hole 22. FIGS. 1 and 3 show that flat-end 14 is also beveled. The preferred embodiment uses a spherical shape less flat-portion 15. The beveling significantly improves the performance of the present invention as it minimizes the amount of screwing and unscrewing of the accessory that is needed to move between modes.

In use, stud-end 12 is screwed into a bow riser so that arm 10 protrudes from the front of the bow riser and so that the axis of pivot 16 is essentially horizontal when the bow riser is vertical. The knurled portion of arm 10 facilitates attaching arm 10 to the bow riser. Nut 18 may be used to assist in tightening the attachment to the bow riser and in causing the desired orientation of pivot 16. (The present invention is usable absent nut 18 should it, the only detachable part of the present invention, become lost.)

Wrist 20 is a cylinder with a central recess that straddles arm 10 and that has three holes. Receiving-hole 22 (only visible on FIG. 3) is centrally placed through the far end or top of wrist 20. It is threaded and of such a size as to receive the threaded end of a stabilizer. A griping-hole 26 pierces each side of wrist 20. Each is normal to the major axis and is slightly smaller in diameter than (and coaxial with) pivot 16. Wrist 20 has the appearance of a saddle and encompasses arm 10.

Figure 4:
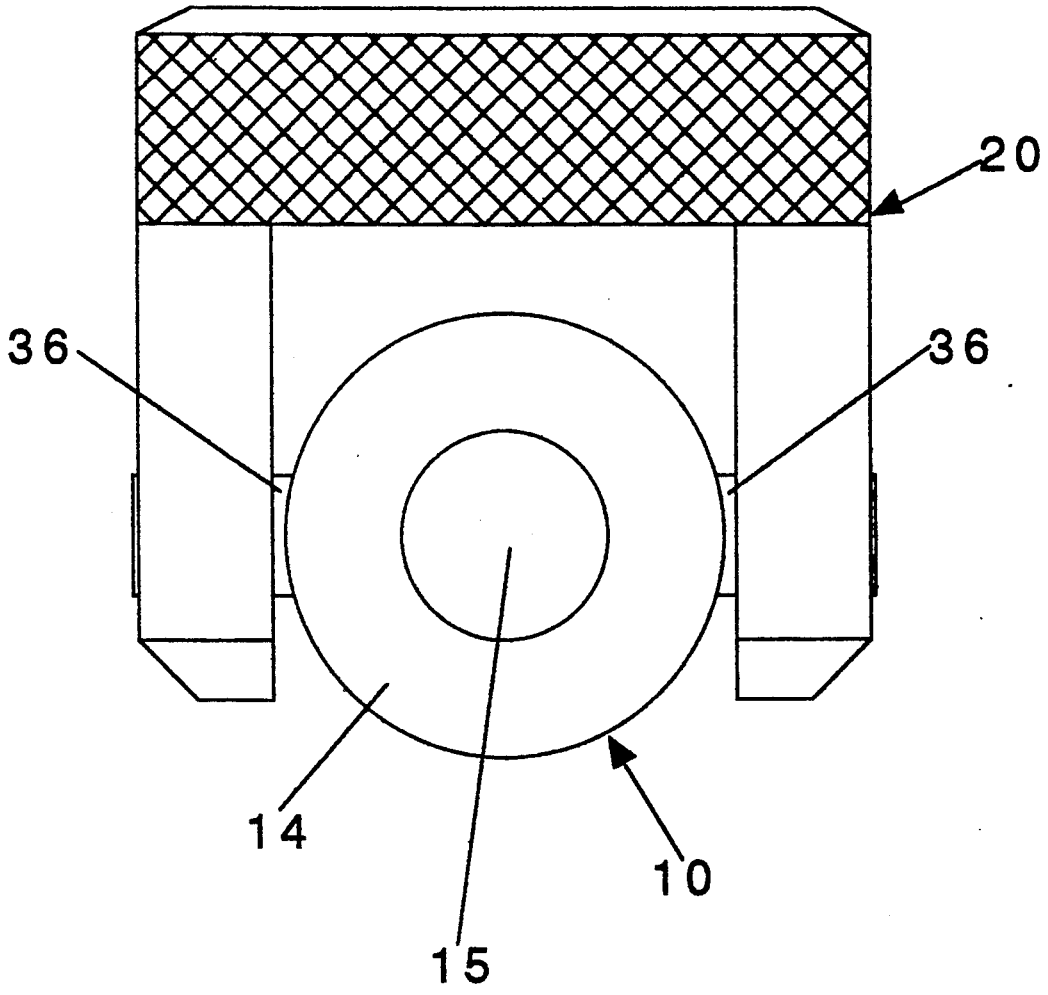
FIG. 4 is a top view with the wrist bent particularly showing the flat-end of the arm

Arm 10 and wrist 20 are rotatably attached by hinge 30. Hinge 30 comprises spring-pin 36 placed through each griping-hole 26 (in wrist 20) and through pivot 16 (in arm 10). Spring-pin 36 is just long enough not to protrude significantly from the ends of griping-holes 26. Spring-pin 36 is formed of an essentially rectangular piece of spring steel having its short dimension slightly smaller than the inside circumference of griping-hole 26. The spring-pin 36 is rolled into a tube shape, passed through griping-holes 26 and pivot 16, and then released. The dimensions of spring-pin 36, griping-holes 26, and pivot 16 are such that the released spring-pin 36 will tightly grip the walls of griping-holes 26 and yet be loosely confined within pivot 16. FIG. 2 shows the gap that necessarily is associated with the presence of spring-pin 36 in griping-hole 26. FIGS. 1, 3, and 4 show the small gap that exists between the attached arm 10 and wrist 20. The form, construction, and placement of spring-pin 36 is such that significantly more tightening torque may safely be used than in previous devices, resulting in both a significantly reduced tendency of the device to unlock or loosen with vibration and an improvement in durability. In the preferred embodiment, the nominal diameter of griping-holes 26 is 0.1875 inches, and the nominal diameter of pivot 16 is 0.1935 inches. The difference between the two aforementioned diameters should be well controlled so as to avoid deficiencies that will result if the difference is too large or too small. The nominal difference of the preferred embodiment is approximately 0.006 inches.

The cross section view of FIG. 3 shows the placement of spring-pin 36 within griping-holes 26 and pivot 16. It also suggests the threaded nature of receiving-hole 22.

To use the described preferred embodiment of the present invention to place the stabilizer in the extended mode, where arm 10 has been attached to wrist 20 by hinge 30, one:

A. screws stud-end 12 into the bow riser using nut 18 to tighten the attachment and to align pivot 16 so as to be essentially horizontal when the bow is in use;

B. pivots wrist 20 so as to align receiving-hole 22 and flat-portion 15; and C. screws the threaded end of the stabilizer into wrist 20 through receiving-hole 22 so that the threaded end of the stabilizer presses against flat-portion 15, compresses spring-pin 36, and causes the stabilizer to be locked and held in the extended mode.

Figure 5:
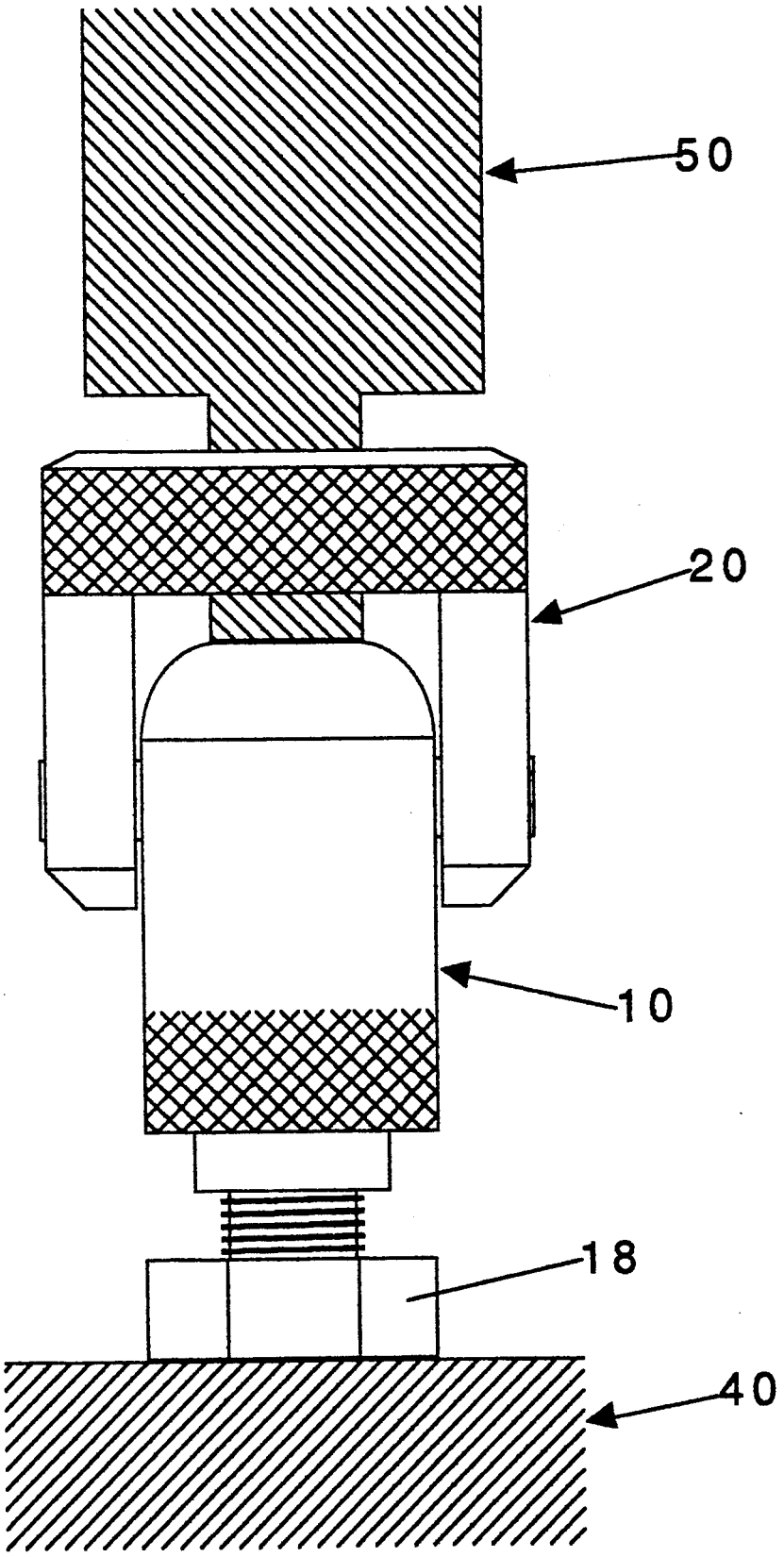
FIG. 5 is a top view of the preferred embodiment with one end attached to a bow riser and the other end holding an extended stabilizer (extended mode)

FIG. 5 shows part of bow-riser 40, part of stabilizer 50, and the preferred embodiment of the present invention interconnected between them as it would be in the extended mode.

When it is desired to place the stabilizer in the folded mode, one:

slightly unscrews the stabilizer from receiving-hole 22, thereby un-compressing spring-pin 36, and providing clearance for the stabilizer and wrist 20 to pivot into the folded mode.

Because of the beveling on the flat-end 14 only a slight amount of unscrewing of the stabilizer is needed.

One may return to the extended mode by swinging the stabilizer and wrist 20 to the horizontal, slightly rotating the stabilizer to cause its threaded end to press snugly against flat-portion 15, and thus lock the stabilizer into the extended mode.

The preferred embodiment of the present invention has been described in detail. The embodiment described is illustrative and not restrictive.

I claim:

1. An elbow for linking a bow and an accessory having a threaded end, comprising:

an elongated arm provided with means for attachment to the bow at one end (bow end) and with the other end (flat end) provided with a flat area that is perpendicular to the axis of said arm;

a saddle shaped wrist having a top, a left side, and a right side, where said wrist loosely encompasses said flat end of said arm, and where said top contains a central, circular, threaded hole passing completely through said top for receiving the threaded end of the accessory; and hinge means interconnecting said arm and said wrist for allowing the pivoting of said arm and said wrist.

2. An elbow as recited in claim 1 wherein said means for attachment to the bow comprises said bow end being threaded for screwing into the bow.

3. An elbow as recited in claim 2 wherein said means for attachment to the bow further comprises a nut engaging said threaded bow end for tightening against the bow.

4. An elbow as recited in claim 1 wherein said flat area is approximately the same as the area of the end of the threaded end of the accessory.

5. An elbow as recited in claim 1 wherein said flat area is centered, circular, and with a diameter approximately the same as that of said threaded hole of said top.

6. An elbow as recited in claim 1 wherein said flat area is centered, circular, and with a diameter not greater than that of said threaded hole of said top.

7. An elbow as recited in claim 1 wherein said flat end of said arm is beveled between said flat area and the elongated surface of said arm.

8. An elbow as recited in claim 7 wherein said bevel is essentially spherical with a diameter approximately that of the thickness of said arm.

9. An elbow as recited in claim 1 wherein said hinge means passes completely through said left side, said arm, and said right side.

10. An elbow as recited in claim 1 wherein said hinge means comprises a single pin that:

passes completely through said left side and is griped tightly therein;

passes loosely and completely through said arm; and passes completely through said right side and is griped tightly therein.

11. An elbow as recited in claim 10 wherein said pin is hollow and made of spring steel.

12. An elbow as recited in claim 10 wherein said pin passes completely through said arm through a cylindrical hole that is slightly larger than said pin.

13. An elbow for linking a bow and an accessory having a threaded end, comprising:

a cylindrical arm with a radius R, a bow-end, and a flat-end;

a means for attachment to the bow is formed on said bow-end;

said flat-end is pierced by a cylindrical hole (pivot-hole) that is centered approximately R from the end of said flat-end and that is perpendicular to the axis of said arm;

said flat-end is beveled in the form of a half-sphere having a radius of approximately R and then a flat-area is formed centered on the end of said flat-end that is perpendicular to the axis of said arm;

a saddle shaped wrist having a top, a left side, and a right side, where said wrist loosely encompasses said flat end of said arm, and where said top contains a centered, circular, threaded hole passing completely through said top for receiving the threaded end of the accessory; and hinge means interconnecting said arm and said wrist for allowing the pivoting of said arm and said wrist.

14. An elbow as recited in claim 13 wherein said hinge means comprises a single pin that:

passes completely through said left side and is griped tightly therein;

passes loosely and completely through said pivot-hole; and passes completely through said right side and is griped tightly therein.

15. An elbow as recited in claim 14 wherein said pin is hollow and made of spring steel.

16. An elbow for linking a bow and an accessory having a threaded end, comprising:

an elongated arm having symmetry about its axis, with one end adapted for attachment to the bow and the other end (flat end) flat along a plane that is perpendicular to the axis of said arm, where an essentially cylindrical opening is centered perpendicular to the axis of said arm and near said flat end (arm opening);

a saddle shaped wrist having a top, a left side, and a right side, where said right side and said left side encompass said flat end of said arm, where said left side and said right side each contain an essentially cylindrical opening (wrist opening) having a slightly smaller diameter than that of said arm opening, where said wrist openings are centrally placed through said right side and said left side coaxial with said arm opening, and where said top contains a central threaded hole for receiving the threaded end of the accessory; and a pin formed from rolling a rectangular piece of material into a cylindrical tube of such an outside diameter that said pin will grip the walls of said wrist openings tightly, said pin is placed through said wrist openings and said arm opening thereby forming a hinge allowing said wrist to pivot about said arm; furthermore when said wrist is pivoted so as to align said threaded hole of said top of said wrist with said flat end of said arm then screwing the threaded end of the accessory through said threaded hole snugly against said flat end will lock said arm and said wrist together.

* * * * *